US005424158A

United States Patent [19]

Murakami et al.

[11] Patent Number: 5,424,158

[45] Date of Patent: Jun. 13, 1995

[54] PHOTOSENSITIVE MATERIAL FOR ELECTROPHOTOGRAPHY COMPRISING METAL FREE PHTHALOCYANINE MOLECULARLY DISPERSED IN THE BINDER POLYMER

[75] Inventors: Mutsuaki Murakami, Tokyo; Atsushi Omote, Kawasaki; Sohji Tsuchiya, Kanagawa, all of Japan

[73] Assignee: Matsushita Electric Industrial Co., Ltd., Osaka, Japan

[21] Appl. No.: 915,387

[22] Filed: Jul. 20, 1992

Related U.S. Application Data

[63] Continuation of Ser. No. 674,998, Mar. 26, 1991, abandoned.

[30] Foreign Application Priority Data

Mar. 26, 1990 [JP] Japan ..... 2-76032
Mar. 26, 1990 [JP] Japan ..... 2-76033

[51] Int. Cl.[6] ..... G03G 15/09

[52] U.S. Cl. ..... 430/83; 430/56; 430/78

[58] Field of Search ..... 430/83, 56, 78

[56] References Cited

U.S. PATENT DOCUMENTS 4,438,187 3/1984 Fushida et al. ..... 430/83
4,868,079 9/1989 Khe et al. ..... 430/72
4,882,254 11/1989 Loutfy et al. ..... 430/83
4,988,592 1/1991 Sakamoto ..... 430/58

FOREIGN PATENT DOCUMENTS 426445 5/1991 European Pat. Off. ..... G03G 5/06

OTHER PUBLICATIONS

Patent Abstracts of Japan, vol. 14, No. 303 (P-1070) (4246) 29 Jun. 1990, & JP-A-2 97956 (Fuji Xerox Co. Ltd.) 10 Apr. 1990.

IBM Technical Disclosure Bulletin. vol. 8, No. 5, May 1965, New York U.S. p. 700 J. Ong, A. H. Sporer: "Phenylquinone sensitizers for polyvinyl carbazole".

Patent Abstracts of Japan vol. 13, No. 508 (P-960) (3856) 15 Nov. 1989, & JP-A-1 206349 (Bridgestone Co.) 18 Aug. 1989.

Patent Abstracts of Japan, vol. 8, No. 31 (P-253) (1468) 9 Feb. 1984, & JP-A-58 184984 (Hitachi Seisakusho K.K.) 28 Oct. 1983.

Patent Abstracts of Japan, vol. 12, No. 417 (P-782) (3264) 7 Nov. 1988, & JP-A-63 155047 (Konica Co.) 28 Jun. 1988.

Patent Abstracts of Japan, vol. 13, No. 231 (P-878) (3579) 29 May 1989, & JP-A-1 40835 (Toshiba Co.) 13 Feb. 1989.

Kakuta et al., "A New Phthalocyanine Photoreceptor for Diode Laser Printers," *Journal of Imaging Technology*, vol. 11, No. 1, Feb. 1985.

Menger et al., "Comparison of Phenolic Couplings on $KMnO_4$ and $K_2MnO_4$ Surfaces," *Journal of Organic Chemistry*, 1985, 50, 3927-3928.

*Primary Examiner*—S. Rosasco
*Attorney, Agent, or Firm*—Lowe, Price, LeBlanc & Becker

[57] ABSTRACT

A photosensitive material for electrophotography, comprises a support and, provided thereon, an organic photoconductive layer of single-layer structure comprising a binder polymer, an electron acceptor substance particulately dispersed in the binder polymer, and a metal-free phthalocyanine molecularly dispersed in the binder polymer.

10 Claims, No Drawings

PHOTOSENSITIVE MATERIAL FOR ELECTROPHOTOGRAPHY COMPRISING METAL FREE PHTHALOCYANINE MOLECULARLY DISPERSED IN THE BINDER POLYMER

This application is a continuation of application Ser. No. 07/674,998 filed Mar. 26, 1991, now abandoned.

BACKGROUND OF THE INVENTION

1. Field of the Invention

This invention relates no a photosensitive material for electrophotography, capable of forming an electrophotographic image. More particularly it relates to an organic photosensitive material or photoconductor for electrophotography.

2. Description of the Prior Art

Organic photoconductors (hereinafter "OPC(s)") have the features such that agents highly sensitive to various wavelengths can be synthesized by molecular design, they are free from environmental pollution and they can enjoy a low cost because of their superior productivity and economical advantages. Thus the OPCs are under energetic research and development. Remarkable improvements have also been made in respect of the durability and sensitivity that have been considered to be problems of the OPCs. Some of them have been put into practical use, and are now prevailing as photosensitive materials for photolithography.

The OPCs are usually used in double-layer structure comprised of a charge-generating layer (hereinafter "CG layer") that absorbs light to generate carriers and a charge transport layer (hereinafter "CT layer") that transports the carriers generated, and it is attempted to to make them more highly sensitive. As agents used in the CG layer (hereinafter "CG agent(s)"), studies are made on various organic agents such as all sorts of perylene compounds, all sorts of phthalocyanine compounds, thiapyrylium compounds, anthanthrone compounds, squarilium compounds, bisazo compounds, trisazo pigments and azuleniun dyes. On the other hand, as compounds used in the CT layer (hereinafter "CT agent(s)"), development has been made on all sorts of hydrazone compounds, oxazole compounds, triphenylmethane compounds and arylamine compounds.

In recent years, there is an increasing demand for the use of OPCs in the near infrared region corresponding with semiconductor laser light (780 to 830 nm), which are used as photosensitive materials for digital recording as in laser printers or the like. Thus, development is energetically made on the OPCs characterized by having a high sensitivity in such a wavelength region. As photosensitive materials for such a region, the OPCs are more advantageous from the viewpoint of sensitivity than inorganic photosensitive materials.

The CG agent and CT agent are applied, together with binder polymers, to a support such as a drum or a belt by relatively simple coating processes to form layers. The binder polymers used for such purpose include polyester resins, polycarbonate resins, acrylic resins and acrylic styrene resins. In the double-layer structure, it is common for the CG layer to be formed in a thickness of several microns and for the CT layer to be formed in a thickness of several ten microns so that a higher sensitivity can be achieved. Here, it is usual for the CG layer to be formed on the support side and for the CT layer to be formed on the surface side on account of their strength, run length, etc. Since what have been put into practical use as the CT agents are only those capable of operating as a result of the transport of positive holes, this double-layer photosensitive material is used according to the negative charge system when it has the layer structure described above.

In this negative charge system, however, there have been the problems that (1) the oxygen in the air turns into ozone, (2) the charge may be imperfect and (3) the photosensitive material tends to be affected by the properties of a drum surface. The ozone is not only harmful to human bodies but also often reacts with the photosensitive material to shorten its lifetime. Instability of charge often brings about a lowering of image quality. The tendency of being greatly affected by the drum surface properties makes it necessary to mirror-finish the drum surface or makes it necessary to provide an undercoat on the drum surface, resulting in an increase in production cost. In addition, in such a double-layer system, there have been the problems that (4) the manufacture requires a complicated process and (5) the layers are questioned about their stability because of their peeling at their interface.

In order to solve such problems, development is energetically being made on OPCs that employ a positive charge system. In order to accomplish the positive charge system, studies have been hitherto made on (a) OPCs of reverse double-layer structure in which the layer structure for the CG layer and CT layer is made reverse to the case of the negative charge system, (b) OPCs of single-layer structure in which a CG agent and a CT agent are dispersed together in a binder polymer, (c) OPCs of single-layer structure in which copper phthalocyanine is dispersed in a polymer, and (d) OPCs of double-layer structure in which an electron-transporting agent that substitutes the conventional hole-transporting agent is used as a CT agent.

In the (a) reverse double-layer structure, like the case of the negative charge system, the problems of the complicated manufacturing process and the peeling at the interface of layers remain unsolved. In addition, since the CG layer, which is essentially required to be made thin, is provided on the surface side of the photosensitive material, a decrease in run length and a deterioration of lifetime characteristics are questioned.

The photosensitive materials aiming at the positive charge system that employs the (b) or (c) single-layer structure have been inferior to conventional double-layer type photosensitive materials of a negative charge system in respect of sensitivity characteristics, charge characteristics (electric charges for charging the photosensitive material can be retained with difficulty) and residual potential (residual potential is large). The reason why they have been inferior in sensitivity is that the generation and transport of electric charges take place at random in one layer. Thus, the problems involved in the single-layer type photosensitive materials are concerned with the sensitivity, the charge characteristics and the residual potential. For this reason, none of single-layer type photosensitive materials have progressed in their practical utilization.

For the (d) method in which an electron-transporting agent is; used as a CT agent, it is still difficult to be put into practical use since no development has been made on good electron-transporting agents.

Compounds known as the electron-transporting agents include 2,4,7-trinitrofluorenone (hereinafter "TFN") and some dephenoquinone derivatives. The TFN has not been actually used because of their problem of cancinogenicity. The diphenoquinone derivatives, on the other hand, are electron-transporting agents recently developed (Yamagushi, Tanaka and Yokoyama, Japan Hard Copy '88 Draft Collections). Studies are made on photosensitive materials of double-layer structure in which this diphenoquinone derivative is dispersed in a polymeric binder and a phthalocyanine pigment, a bisazo pigment, a perylene pigment or the like is used as a charge-generating agent. The photosensitive materials of this type, however, have large residual potential and have been of no practical use.

As discussed above, all the OPCs aiming at the positive charge system have been involved in any problems.

In the meantime, it has been reported that a function-separated type laminated photosensitive material comprised of a CT layer comprising a disperse system of a diphenoquinone derivative and a polymer and a CG layer comprising a phthalocyanine pigment, a bisazo pigment, a perylene pigment or the like can give a superior sensitivity (Yamaguchi, Tanaka and Yokoyama, Japan Hard Copy '88, p. 71). The photosensitive material constituted in this way has so large a residual potential that there are many problems from a practical viewpoint. Moreover, this photosensitive material, which is constituted as a function-separated type (multi-layer structure), has the problems of the complicated manufacturing process and the peeling at the interface of layers.

SUMMARY OF THE INVENTION

The single-layer type photosensitive materials of a positive charge system are basically free from the disadvantages pertaining to the multi-layer type photosensitive materials of a negative charge system and also free from the disadvantages pertaining to the reverse-layer type photosensitive materials of a positive charge system. Thus, taking notice of the possibility that an ideal photosensitive material would become available if the single-layer type photosensitive materials of a positive charge system can achieve the same high-sensitivity, residual potential and charge characteristics as the double-layer type, an object of the present invention is to provide a positive-charge single-layer type OPC that can eliminate the above disadvantages pertaining to the conventional positive-charge single-layer type photosensitive materials, can achieve a high performance and a high sensitivity, and also can promise a superior durability.

Another object of the present invention is to develop and provide a positive-charge single-layer type OPC having employed the electron-transporting agent that has been hitherto little studied.

To achieve the above objects, the present invention provides a photosensitive material for electrophotography, comprising a support and, provided thereon, an organic photoconductive layer of single-layer structure comprising a binder polymer, an electron acceptor substance dispersed in the binder polymer in a particulate order, and a molecularly dispersed substance dispersed in the binder polymer in a molecular order.

In a preferred embodiments of the present invention, this molecularly dispersed substance comprises a metal-free phthalocyanine and the electron acceptor substance comprises a quinone derivative.

DESCRIPTION OF THE PREFERRED EMBODIMENTS

Preferred embodiments of the present invention will be described below.

The constitution of the present invention is firstly characterized by a single-layer structure wherein at least two kinds of photosensitive agents are present in a single layer, one of which is dispersed in a molecular order (i.e., molecularly dispersed) and the other of which is dispersed in a particulate order (i.e., particulately dispersed). In this embodiment, the substance shown below is used as the particulately dispersed photosensitive agent and a metal-free phthalocyanine is used as the molecularly dispersed photosensitive agent.

The photosensitive material with this constitution, a first embodiment, has a sensitivity reaching from 0.6 lux.sec to 3.0 lux.sec, which is a remarkably high sensitivity compared with the conventional single-layer type OPCs. The OPC of the present embodiment has also an excellent sensitivity to the light in a broad wavelength region of from 500 nm to 800 nm, and has a residual potential of not more than 30 V.

As the electron acceptor substance used in the first embodiment, it is effective to use quinone derivatives or diphenoquinone derivatives. Particularly effectively usable quinone derivatives and diphenoquinone derivatives may include the following substances:

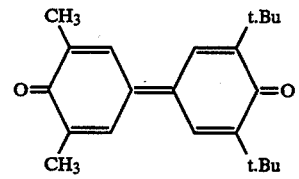

(1)

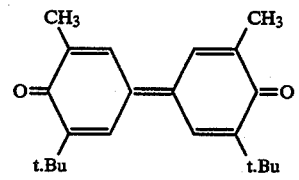

(2)

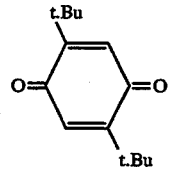

(3)

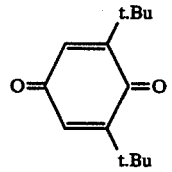

(4)

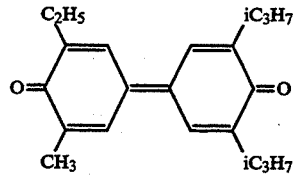

(5)

The quinone derivatives and diphenoquinone derivatives are by no means limited to those shown above, and the quinone derivatives and diphenoquinone derivatives shown below can also be widely used. Here, $R_1$, $R_2$, $R_3$ and $R_4$ each represent a hydrogen atom, an alkyl group or an alkoxyl group.

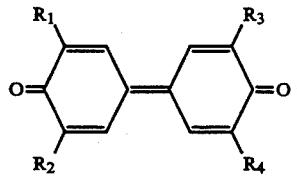

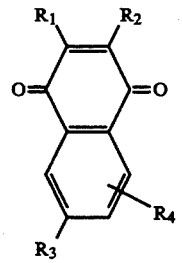

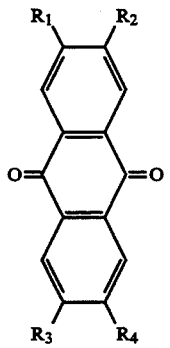

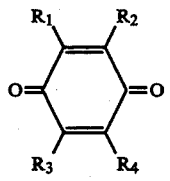

The molecularly dispersed substance used in the first embodiment comprises a metal-free phthalocyanine. There are no particular limitations on the metal-free phthalocyanine. An X-type metal-free phthalocyanine or $\tau$-type metal-free phthalocyanine can be particularly effectively used.

In this first embodiment, as will be clear from what has been mentioned above, at least part of the metal-free phthalocyanine must be dispersed in a binder polymer in a molecular order. In order to achieve such a molecularly dispersed state, it is necessary to dissolve the metal-free phthalocyanine in a suitable solvent and to select as a binder a polymer capable of being dissolved in such a solvent.

In order to obtain the photoconductive layer having the structure of the present invention by the use of the binder thus selected, the solvent, the metal-free phthalocyanine and the quinone or quinodimethane derivative, it is in the first place necessary to thoroughly mix these components with stirring. With progress of mixing, an abrupt increase in the viscosity of the solution is usually observed. The mixing with stirring can be deemed to have been completed when the increase in viscosity stops. For such stirring it usually takes a day or two days or more. A coating solution thus prepared is coated by a conventional method, followed by drying to form the photoconductive layer. In the observation of optical absorption spectra, two absorption peaks appear at 620 nm and 790 nm when X-type metal-free phthalocyaninea is particulately dispersed. On the other hand, in respect of the photoconductive layer produced by the method of the present invention, a broad absorption ranging from 650 to 750 nm and two sharp absorptions at 650 nm and 685 nm appear, which show that the X-type metal-free phthalocyanine is molecularly dispersed. As for the quinone or quinodimethane, the greater part thereof is in a particulately dispersed state.

The solvent suited for such purpose, capable of dissolving the metal-free phthalocyanine, may include nitrobenzene, chlorobenzene, dichlorobenzene, dichloromethane, trichloroethylene, chloronaphthalene, methylnaphthalene, benzene, toluene, xylene, tetrahydrofuran, cyclohexanone,1,4-dioxane, N-methylpyrrolidone, carbon tetrachloride, bromobutane, ethylene glycol, sulfolane, ethylene glycol monobutyl ether, acetoxyethoxyethane and pyridine. The solvent used in the present embodiment is by no means limited to the above solvents. These solvents may be used alone or in the form of a mixture of two or more kinds.

Solvents such as acetone, cyclohexane, petroleum ether, methoxyethanol, acetonitrile, ethyl acetate, isopropyl alcohol, diethyl ether, methyl ethyl ketone, ethanol, hexane, propylene carbonate, butylamine and water usually do not dissolve the metal-free phthalocyanine. Hence, in the present embodiment, these solvents can not be used alone. When any of these solvents are used, they must be used in combination with the solvents capable of dissolving the metal-free phthalocyanine.

The binder polymer used in the present embodiment should be those capable of being dissolved in the solvent capable of dissolving the metal-free phthalocyanine. The polymer suited for such purpose may include polyester, polyvinyl acetate, polyvinyl chloride, polyvinylidene chloride, polycarbonate, polyvinyl butyral, polyvinyl acetoacetal, polystyrene, polyacrylonitrile, polymethyl methacrylate, polyacrylate, polyvinyl carbazole, copolymers of any of these, poly(vinyl chloride/vinyl acetate/vinyl alcohol), poly(vinyl chloride/vinyl acetate/maleic acid), poly(ethylene/vinyl acetate), poly(vinyl chloride/vinylidene chloride), cellulose polymers, and all sorts of siloxane polymers. The binder polymer used in the present embodiment is by no means limited to the above polymers. These polymers may be used alone or in the form of a mixture of two or more kinds. When the above solvents are used in combination of two or more kinds, it is possible to dissolve the metal-free phthalocyanine with one solvent and to dissolve the binder polymer with the other solvent.

An optimum proportion of the photosensitive agents (the metal-free phthalocyanine and the electron acceptor substance) to the binder polymer is in the range of from 1:1 to 1:10 in weight ratio. Use of the photosensitive agents in amounts larger than this proportional range may bring about superior photosensitivity characteristics but may-result in poor charge characteristics, generally making it difficult to retain a potential of 300 V or more. On the other hand, use of the binder polymer in an amount larger than the above proportional range may bring about poor photosensitivity characteristics. As for the proportion of the metal-free phthalocyanine to the electron acceptor substance, excellent characteristics can be exhibited when they are used in the range of as wide as from 2:1 to 1:20 in weight ratio.

Because of such combination of agents, it was confirmed that, for example, in a system in which the X-type metal-free phthalocyanine, the diphenoquinone compound (1) and polyvinyl butyral were used in a proportion of 1:2:12 in weight ratio, a high sensitivity of 1.01 lux.sec (charge potential: 530 V) was obtained, in terms of half decay exposure sensitivity obtained by positive charging, and the sensitivity at 800 nm was 2.0 $cm^2/\mu J$. On the other hand, the sensitivity obtained by negative charging was 15 lux.sec (charge potential: 110 V) and dark decay characteristics were very poor, showing that the characteristics were seriously inferior to those obtained by positive charging. This system was so stable that the characteristics obtainable by positive charging little changed even after a 1,000 time charging test. Moreover, this photosensitive material showed a superior heat resistance, where it caused little changes in its characteristics even when treated at 100° C. for 48 hours.

The organic photoconductive layer (hereinafter often "OPC layer") constituted as described above is provided on a conductive support serving as a substrate therefor. There are no particular limitations on the conductive support. It can be appropriately selected depending on the purpose for which the OPC of the present invention is used. More specifically, preferably usable supports are those made of a metal such as aluminum, and those comprised of glass, paper or plastic on the surface of which a conductive layer has been formed by metal vacuum deposition or the like. As for the form thereof, the support can be of any form such as a drum, a belt or a sheet.

The photosensitive material for electrophotography according to the present embodiment can be used in various recording systems such as copying machines, printers and facsimile machines, without any limitations on its uses. The photosensitive material for electrophotography according to the present embodiment may not be limited to what are embodied as described above. For example, if necessary, a surface protective layer comprised of an insulative resin may be further formed on the OPC layer or a blocking layer may also be provided between the photosensitive layer and the support.

This first embodiment of the present invention will be described later in greater detail in Examples 1 to 3 together with Comparative Example 1.

The constitution of the present invention is secondly characterized by a single-layer structure wherein a photosensitive agent is present in at least two states, one of which is dispersion in a molecular order (i.e., a molecularly dispersed state) and the other of which is dispersion in a particulate order (i.e., a particulately dispersed state). The photosensitive material with this constitution, a second embodiment, has a sensitivity reaching from 1.0 lux.sec to 3.0 lux.sec, which is a remarkably high sensitivity compared with the conventional single-layer type OPCs. The OPC of the present embodiment has also an excellent sensitivity to the light in a broad wavelength region of from 500 nm to 600 nm, and has a residual potential of not more than 30 V.

As the electron acceptor substance used in the present embodiment, it is possible to use the same quinone derivatives and diphenoquinone derivatives as those described in the first embodiment.

In this second embodiment, at least part of the electron acceptor substance must be dispersed in a binder polymer in a molecular order. In order to achieve such a molecularly dispersed state, it is necessary to dissolve the electron acceptor substance in a suitable solvent and to select as a binder a polymer capable of being dissolved in such a solvent.

The solvent suited for such purpose, capable of dissolving the electron acceptor substance, may include nitrobenzene, chlorobenzene, dichlorobenzene, dichloromethane, trichloroethylene, chloronaphthalene, methylnaphthalene, benzene, toluene, xylene, tetrahydrofuran, cyclohexanone, 1,4-dioxane, N-methylpyrrolidone, carbon tetrachloride, bromobutane, ethylene glycol, sulfolane, ethylene glycol monobutyl ether, acetoxyethoxyethane and pyridine. The solvent used in the present embodiment is by no means limited to the above solvents. These solvents may be used alone or in the form of a mixture of two or more kinds.

The binder polymer used in the present embodiment should be those capable of being dissolved in the solvent capable of dissolving the electron acceptor substance. The polymer suited for such purpose may include polyester, polyvinyl acetate, polyvinyl chloride, polyvinylidene chloride, polycarbonate, polyvinyl butyral, polyvinyl acetoacetal, polystyrene, polyacrylonitrile, polymethyl methacrylate, polyacrylate, polyvinyl carbazole, copolymers of any of these, poly(vinyl chloride/vinyl acetate/vinyl alcohol), poly(vinyl chloride/vinyl acetate/maleic acid), poly(ethylene/vinyl acetate), poly(vinyl chloride/vinylidene chloride), cellulose polymers, and all sorts of siloxane polymers. The binder polymer used in the present embodiment is by no means limited to the above polymers. These polymers may be used alone or in the form of a mixture of two or more kinds. When the above solvents are used in combination of two or more kinds, it is possible to dissolve the electron acceptor substance with one solvent and to dissolve the binder polymer with the other solvent.

An optimum proportion of the photosensitive agent (the electron acceptor substance) to the binder polymer is in the range of from 1:1 to 1:10 in weight ratio. Use of the photosensitive agent in an amount larger than this proportional range may bring about superior photosensitivity characteristics but may result in poor charge characteristics, generally making it difficult to retain a potential of 500 V or more. On the other hand, use of the binder polymer in an amount larger than the above proportional range may bring about poor photosensitivity characteristics.

What is important in the above procedure is to carry out thorough mixing so that the molecularly dispersed state and the particulately dispersed state can be stably produced. In general, in order to produce such a stable mixed state, it takes 24 hours or more when usual mixing is carried out. Insufficient stirring results in a large residual potential, making it impossible to obtain practically useful characteristics. In this case also, with progress of mixing, an abrupt increase in the viscosity of the solution is usually observed. The mixing with stirring can be deemed to have been completed when the increase in viscosity stops. A coating solution thus prepared is coated by a conventional method, followed by drying to form the photoconductive layer. In the observation of optical absorption spectra, absorptions similar to spectra of a solution kept in a molecularly dispersed state appear in addition to spectra of powder particles;, which show that the photosensitive agent is molecularly dispersed.

Because of such combination of agents, it was confirmed that, for example, in a system in which the diphenoquinone compound (1) and polyvinyl butyral were used in a proportion of 1:4 in weight ratio, a high sensitivity of 1.6 lux.sec (charge potential: 800 V) was obtained, in terms of half decay exposure sensitivity obtained by positive charging, and the sensitivity at 550 nm was 1.5 $cm^2/\mu J$. The residual potential was 20 V or less. On the other hand, the sensitivity obtained by negative charging was 20 lux.sec (charge potential: 350 V) and dark decay characteristics were very poor, showing that the characteristics were seriously inferior to those obtained by positive charging. This system was so stable that the characteristics obtainable by positive charging little changed even after a 1,000 time charging test. Moreover, this photosensitive material showed a superior heat resistance, where it caused little changes in its characteristics even when treated at 100° C. for 8 hours.

The organic photoconductive layer constituted as described above is provided on a conductive support serving as a substrate therefor. There are no particular limitations on the conductive support. It can be appropriately selected depending on the purpose for which the OPC of the present invention is used. More specifically, preferably usable supports are those made of a metal such as aluminum, and those comprised of glass, paper or plastic on the surface of which a conductive layer has been formed by metal vacuum deposition or the like. As for the form thereof, the support can be of any form such as a drum, a belt or a sheet.

The photosensitive material for electrophotography according to the present embodiment can also be used in various recording systems such as copying machines, printers and facsimile machines, without any limitations on its uses. The photosensitive material for electrophotography according to the present embodiment may not be limited to what are embodied as described above. For example, if necessary, a surface protective layer comprised of an insulative resin may be further formed on the OPC layer or a blocking layer may also be provided between the photosensitive layer and the support.

This second embodiment of the present invention will be described later in greater detail in Examples 4 to 6.

EXAMPLE 1

An X-type metal-free phthalocyanine (hereinafter "XPc"; trade name: Fastogen Blue 8120B; produced by Dainippon Ink & Chemicals, Incorporated), the diphenoquinone compound (1) (synthesized according to the method disclosed in F. Menger and D. Carnahan, J. Organic Chemistry, Vol. 50, 3927, 1985) and polyvinyl butyral (hereinafter "PVB"; trade name: Eslec BM-2; produced by Sekisui Chemical Co., Ltd.) were weighed in a proportion of 1:2:12 in weight ratio. First, the PVB and XPc were dissolved in tetrahydrofuran, which were then thoroughly mixed by stirring. Thereafter, the compound (1) was added to the mixture, followed by further thorough mixing by stirring. The solution thus obtained was applied to an aluminum drum by dip coating, followed by treatment in vacuum at 120° C. for 1 hour to form an OPC layer (thickness: about 15 μm).

To examine the photosensitivity characteristics of the photosensitive material thus obtained, the photosensitive material was irradiated with white light using a tungsten lamp and photosensitivity (half decay exposure. $E_{\frac{1}{2}}$) obtained by positive charging was measured by the use of a paper analyzer EPA-8100 Type, manufactured by Kawaguchi Denki K.K. The photosensitivity after a 1,000 time charging test was also measured in the same manner. Wavelength characteristics within the range of from 400 to 1,000 nm were also measured. As a result, the charge potential (6 kV charging) was 600 V; the photosensitivity ($E_{\frac{1}{2}}$) under white light, 1.2 lux.sec; the photosensitivity ($E_{\frac{1}{2}}$) after 1,000 time charging, 1.4 lux.sec; wavelength characteristics (photosensitivity at 550 nm and 800 nm), 2.2 $cm^2/\mu J$ and 2.0 $cm^2/\mu J$; and residual potential (1 second after irradiation with light of 10 lux), 10 V.

The photosensitive material prepared by the method of Example 1 was tested for its run length in continuous use. The test was carried out using A4 test paper to reveal that the photosensitive material stably operated throughout a 50,000 sheet running test. Thus the photosensitive material of the present invention was confirmed to be superior also in respect of the run length compared with conventional double-layer type photosensitive materials or single-layer type photosensitive materials.

COMPARATIVE EXAMPLE 1

For comparison, Example 1 was repeated to examine the noted characteristics, except that a mixed solvent of acetone and DMF was used as the solvent. The acetone and DMF dissolve PVB but do not dissolve XPc. Hence, according to such a preparation method, it can be presumed that the XPc was mixed in the PVB in a particulately dispersed state and no XPc was present in a molecularly dispersed state. As a result, the photosensitivity was 18 lux.sec and the residual potential was 150 V, which were seriously poorer characteristics than those in Example 1.

EXAMPLE 2

A τ-type metal-free phthalocyanine (hereinafter "τPc"; trade name: Liophoton THP; produced by Toyo Ink Mfg. Co., Ltd.), the diphenoquinone compound (2) (synthesized according to the method disclosed in F. Menger and D. Carnahan, J. Organic Chemistry, Vol. 50, 3927, 1985) and PVB (trade name: Eslec BM-2; produced by Sekisui Chemical Co., Ltd.) were weighed in a proportion of 1:3:15 in weight ratio, and were treated in the same manner as in Example 1. After these were throughly mixed by stirring, the solution thus obtained was applied to an aluminum drum by dip coating, followed by treatment in vacuum at 100° C. for 1 hour to form an OPC layer (thickness: 15 μm).

To examine the photosensitivity characteristics of the photosensitive material thus obtained, the photosensitive material was irradiated with white light using a tungsten lamp and photosensitivity (half decay exposure, $E_{\frac{1}{2}}$) obtained by positive charging was measured by the use of a paper analyzer EPA-8100 Type, manufactured by Kawaguchi Denki K.K. The photosensitivity after a 1,000 time charging test was also measured in the same manner. Wavelength characteristics within the range of from 400 to 1,000 nm were also measured. As a result, the charge potential was 700 V; the photosensitivity ($E_{\frac{1}{2}}$) under white light, 1.4 lux.sec; the photosensitivity ($E_{\frac{1}{2}}$) after 1,000 time charging, 1.5 lux.sec; wavelength characteristics (photosensitivity at 550 nm and 800 nm), 2.0 $cm^2/\mu J$ and 1.6 $cm^2/\mu J$; and residual potential (1 second after irradiation with light of 10 lux), 10 V. From these results, it was made clear that the τ-type metal-free phthalocyanine showed excellent photosensitivity characteristics like the X-type metal-free phthalocyanine.

EXAMPLE 3

The same XPc as used in Example 1, the quinone compound (3) and a binder polymer in various kinds as shown in Table 1 were mixed in a proportion of 1:5:25 in weight ratio, and were dissolved in a mixed solvent of tetrahydrofuran and methylnaphthalene. After these were throughly mixed by stirring, the solution thus obtained was applied to an aluminum drum by dip coating, followed by treatment in vacuum at 120° C. for 4 hour to form an OPC layer (thickness: 15 to 20 μm).

To examine the photosensitivity characteristics of the photosensitive material thus obtained, the photosensitive material was irradiated with white light using a tungsten lamp and photosensitivity (half decay exposure, $E_{\frac{1}{2}}$) obtained by positive charging was measured by the use of a paper analyzer EPA-8100 Type, manufactured by Kawaguchi Denki K.K. The photosensitivity after a 1,000 time charging test was also measured in the same manner. Wavelength characteristics within the range of from 500 to 900 nm were also measured. Characteristics thus obtained are shown in Table 1.

TABLE 1

| Binder polymer | Charge (V) | Photosensitivity (lux · sec) | After 1,000 times (lux · sec) | Wavelength characteristics ($cm^2/\mu J$) |
|---|---|---|---|---|
| Polyester | 850 | 1.3 | 1.2 | 1.5 |
| PVC/PVC | 650 | 1.8 | 2.0 | 1.2 |
| PVC/PVC/PVA | 750 | 2.2 | 2.3 | 1.4 |
| PVC/PVC/maleic acid | 770 | 1.8 | 2.0 | 1.4 |
| Polycarbonate | 720 | 1.6 | 1.8 | 1.5 |
| Polystyrene | 900 | 2.4 | 2.5 | 1.2 |

PVC: Polyvinyl chloride
PVA: Polyvinyl alcohol

As is clear from these results, the method used in the present invention can be applied to a vast range of polymers

EXAMPLE 4

The same diphenoquinone compound (1) as used in Example i. (synthesized according to the method disclosed in F. Menger and D. Carnahan, J. Organic Chemistry, Vol. 50, 3927, 1985) and PVB (trade name: Eslec BM-2; produced by Sekisui Chemical Co., Ltd.) were weighed in a proportion of 1:3 in weight ratio. First, the PVB was dissolved in a mixed solvent of tetrahydrofuran and chloroform, and then the compound (1) was added. The mixture was stirred for 3 days until the components were thoroughly mixed. The solution thus obtained was applied to an aluminum drum by did coating, followed by treatment in vacuum at 120° C. for 4 hour to form an OPC layer (thickness: about 15 μm).

To examine the photosensitivity characteristics of the photosensitive material thus obtained, the photosensitive material was irradiated with white light using a tungsten lamp and photosensitivity (half decay exposure, $E_{\frac{1}{2}}$) obtained by positive charging was measured by the use of a paper analyzer EPA-8100 Type, manufactured by Kawaguchi Denki K.K. The photosensitivity after a 1,000 time charging test was also measured in the same manner. Wavelength characteristics at 500 nm were also measured. As a result, the charge potential (6 kV charging) was 650 V; the photosensitivity ($E_{\frac{1}{2}}$) under white light, 1.5 lux.sec; the photosensitivity ($E_{\frac{1}{2}}$) after 1,000 time charging, 1.6 lux.sec; wavelength characteristics (photosensitivity at 550 nm), 1.2 $cm^2/\mu J$; and residual potential (1 second after irradiation with light of 10 lux), 10 V.

The photosensitive material prepared by the method of Example 4 was tested for its run length in continuous use. The test was carried out using A4 test paper to reveal that at the photosensitive material stably operated throughout a 50,000 sheet running test. Thus the photosensitive material of the present invention was confirmed to be superior also in respect of the run length compared with conventional double-layer type photosensitive materials or single-layer type photosensitive materials.

EXAMPLE 5

The same diphenoquinone compound (2) as used in Example 2 (synthesized according to the method disclosed in F. Menger and D. Carnahan, J. Organic Chemistry Vol. 50, 3927, 1985) and PVB (trade name: Eslec BM-2; produced by Sekisui Chemical Co., Ltd.) were weighed in a proportion of 1:3 in weight ratio, and were treated in the same manner as in Example 1. After these were throughly mixed by stirring, the solution thus obtained was applied to an aluminum drum by dip coating, followed by treatment in vacuum at 100° C. for 1 hour to form an OPC layer (thickness: 15 μm).

To examine the photosensitivity characteristics of the photosensitive material thus obtained, the photosensitive material was irradiated with white light using a tungsten lamp and photosensitivity (half decay exposure. $E_{\frac{1}{2}}$) obtained by positive charging was measured by the use of a paper analyzer EPA-8100 Type, manufactured by Kawaguchi Denki K.K. The photosensitivity after a 1,000 time charging test was also measured in the same manner. Wavelength characteristics at 500 nm were also measured. As a result, the charge potential (6 kV charging) was 750 V; the photosensitivity ($E_{\frac{1}{2}}$) under white light, 1.8 lux.sec; the photosensitivity ($E_{\frac{1}{2}}$) after 1,000 time charging, 2.0 lux.sec; wavelength characteristics (photosensitivity at 550 nm), 1.0 $cm^2/\mu J$; and residual potential (1 second after irradiation with light of 10 lux), 15 V. From these results, it was made clear that the compound (2) showed excellent photosensitivity characteristics like the compound (1).

EXAMPLE 6

The same quinone compound (3) as used in Example 3 and a binder polymer in various kinds as shown in Table 2 were mixed in a proportion of 1:4 in weight ratio, and were dissolved in a mixed solvent of tetrahydrofuran and methylnaphthalene. After these were throughly mixed by stirring, the solution thus obtained was applied to an aluminum drum by dip coating, followed by treatment in vacuum at 120° C. for 4 hour to form an OPC layer (thickness: 15 to 20 μm).

To examine the photosensitivity characteristics of the photosensitive material thus obtained, the photosensitive material was irradiated with white light using a tungsten lamp and photosensitivity (half decay exposure, $E_{\frac{1}{2}}$) obtained by positive charging was measured by the use of a paper analyzer EPA-8100 Type, manufactured by Kawaguchi Denki K.K. The photosensitivity after a 1,000 time charging test was also measured in the same manner. Wavelength characteristics at 500 nm were also measured. Characteristics thus obtained are shown in Table 2.

TABLE 2

| Binder polymer | Charge (V) | Photo-sensi-tivity (lux · sec) | After 1,000 times (lux · sec) | Wave-length charac-teristics ($cm^2/\mu J$) |
|---|---|---|---|---|
| Polyester | 850 | 2.2 | 2.2 | 1.0 |
| PVC/PVC | 900 | 2.4 | 2.6 | 1.0 |
| PVC/PVC/PVA | 750 | 2.0 | 2.3 | 1.2 |
| PVC/PVC/maleic acid | 800 | 1.8 | 1.8 | 1.1 |
| Polycarbonate | 900 | 1.8 | 1.8 | 1.2 |
| Polystyrene | 950 | 2.4 | 2.5 | 0.9 |

PVC: Polyvinyl chloride
PVA: Polyvinyl alcohol

As is clear from these results, the method used in the present invention can be applied to a vast range of polymers.

The positive-charge single-layer type OPCs according to the embodiments described above is constituted in the manner hitherto unknown, can attain superior characteristics required as a photosensitive material, and have the following characteristic features compared with conventional photosensitive materials.

(1) Since it is basically of single-layer structure, it can be manufactured through a simple process.

(2) Since it is of single-layer structure, it has a superior run length.

(3) It has a higher sensitivity than the conventional OPCs of single-layer structure have.

(4) It can be superior in stability and chargeability compared with those of the conventional OPCs of single-layer structure.

(5) In particular, it shows superior characteristics in the positive charge system.

(6) It shows superior sensitivity within the wavelength region of from 500 to 800 nm.

(7) It has superior residual potential characteristics compared with the conventional OPCs of single-layer structure.

What is claimed is:

1. A photosensitive material for electrophotography, comprising a support and, provided thereon, an organic photoconductive layer of single-layer structure comprising a binder polymer, an electron acceptor substance particulately dispersed in the binder polymer, and a metal-free phthalocyanine molecularly dispersed in the binder polymer.

2. A photosensitive material for electrophotography according to claim 1, wherein said organic photoconductive layer further comprises a second particulately dispersed substance in said binder polymer.

3. A photosensitive material for electrophotography according to claim 2, wherein said electron acceptor substance is a quinone derivative or a diphenoquinone derivative, and said second particulately dispersed substance is a metal-free phthalocyanine.

4. A photosensitive material for electrophotography according to claim 2, wherein the weight ratio of the total weight of said electron acceptor substance, said molecularly dispersed substance and said second particulately dispersed substance to the weight of said binder polymer is in the range of from 1:1 to 1:10.

5. A photosensitive material for electrophotography according to claim 1, wherein said electron acceptor substance is a quinone derivative or a diphenoquinone derivative.

6. A photosensitive material for electrophotography according to claims 5 or 3, wherein said quinone derivative or diphenoquinone derivative is selected form the group consisting of the following:

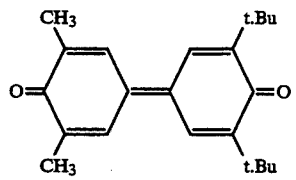

(1)

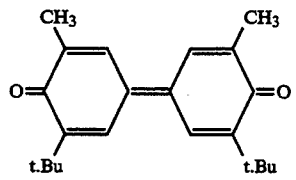

(2)

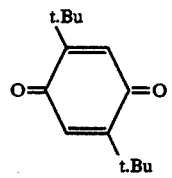

(3)

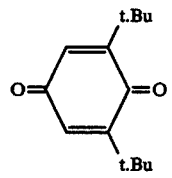

(4)

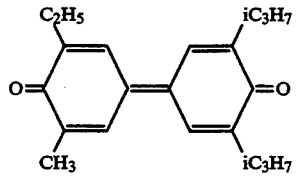

(5)

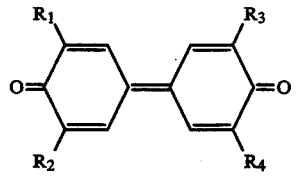

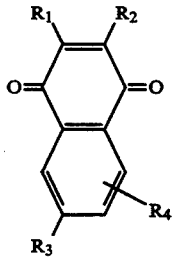

-continued

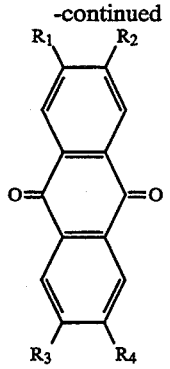

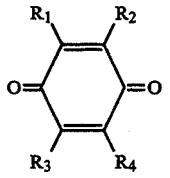

wherein $R_1$, $R_2$, $R_3$ and $R_4$ each represent a hydrogen atom, an alkyl group or an alkoxyl group.

7. A photosensitive material for electrophotography according to claim 1, wherein the weight ratio of the total weight of said electron acceptor substance and said molecularly dispersed substance to the weight of said binder polymer is in the range of from 1:1 to 1:10.

8. A photosensitive material for electrophotography according to claim 1, wherein said metal-free phthalocyanine is selected from the group consisting of an X-type metal-free phthalocyanine and a $\tau$-type metal-free phthalocyanine.

9. A photosensitive material for electrophotography according to claim 1, wherein said binder polymer is selected from the group consisting of polyester, polyvinyl acetate, polyvinyl chloride, polyvinylidene chloride, polycarbonate, polyvinyl butyral, polyvinyl acetoacetal, polystyrene, polyacrylonitrile, polymethyl methacrylate, polyacrylate, polyvinyl carbazole, a copolymer of any of these, poly(vinyl chloride/vinyl acetate/vinyl alcohol), poly(vinyl chloride/vinyl acetate/maleic acid), poly(ethylene/vinyl acetate), poly(vinyl chloride/vinylidene chloride), a cellulose polymer and a siloxane polymer.

10. A photosensitive material for electrophotography according to claim 1, wherein the metal-free phthalocyanine is molecularly dispersed in the binder polymer by dissolving the metal-free phthalocyanine and the binder polymer in a solvent.

* * * * *